US008399828B2

(12) United States Patent
Vestal

(10) Patent No.: US 8,399,828 B2
(45) Date of Patent: Mar. 19, 2013

(54) MERGED ION BEAM TANDEM TOF-TOF MASS SPECTROMETER

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 0 days.

(21) Appl. No.: 12/651,070

(22) Filed: Dec. 31, 2009

(65) Prior Publication Data

US 2011/0155901 A1 Jun. 30, 2011

(51) Int. Cl.
*H01J 49/00* (2006.01)

(52) U.S. Cl. ..... 250/285; 250/281; 250/282; 250/287

(58) Field of Classification Search ..... 250/287, 250/285

See application file for complete search history.

(56) References Cited

U.S. PATENT DOCUMENTS

| | | | | |
|---|---|---|---|---|
| 5,087,815 | A * | 2/1992 | Schultz et al. | 850/63 |
| 5,144,127 | A | 9/1992 | Williams et al. | |
| 5,160,840 | A | 11/1992 | Vestal | |
| 5,166,518 | A | 11/1992 | Freedman | |
| 5,625,184 | A | 4/1997 | Vestal et al. | |
| 5,627,369 | A | 5/1997 | Vestal et al. | |
| 5,847,385 | A | 12/1998 | Dresch | |
| 6,057,543 | A | 5/2000 | Vestal et al. | |
| 6,066,848 | A * | 5/2000 | Kassel et al. | 250/288 |
| 6,300,627 | B1 | 10/2001 | Koster et al. | |
| 6,489,610 | B1 | 12/2002 | Barofsky et al. | |
| 6,512,225 | B2 | 1/2003 | Vestal et al. | |
| 6,534,764 | B1 | 3/2003 | Verentchikov et al. | |

(Continued)

FOREIGN PATENT DOCUMENTS

| | | | |
|---|---|---|---|
| WO | 2006/064280 | A2 | 6/2006 |
| WO | 2006-064280 | A2 | 6/2006 |

(Continued)

OTHER PUBLICATIONS

"Notification Concerning Transmittal of International Preliminary Report on Patentability (Chapter I of the Patent Cooperation Treaty)" For PCT/US2009/045108, Dec. 9, 2010, 9 pages, The International Bureau of WIPO, Geneva, Switzerland.

(Continued)

*Primary Examiner* — Robert Kim
*Assistant Examiner* — Jason McCormack
(74) *Attorney, Agent, or Firm* — Kurt Rauschenbach; Rauschenbach Patent Law Group, LLC

(57) ABSTRACT

A tandem time-of-flight mass spectrometer includes a first pulsed ion source that produces ions with a first mass and charge that directs the ions into a first stage of a tandem TOF mass spectrometer. In addition, a second pulsed ion source produces ions with a second mass and an opposite charge directs the ions into the first stage of the tandem TOF mass spectrometer. A field-free reaction region is positioned in the ion flight path so that ions from first and second pulsed ion source arrive at the entrance of the field-free reaction region substantially simultaneously in at least one of time and space. At least some of the ions from the first and second pulsed ion source are fragmented by ion-ion collision between positive and negative ions. A second stage of the tandem mass spectrometer separates fragment ions produced in the reaction region according to their mass-to-charge ratio.

29 Claims, 5 Drawing Sheets

U.S. PATENT DOCUMENTS

| | | | | |
|---|---|---|---|---|
| 6,621,074 | B1 | 9/2003 | Vestal | |
| 6,872,941 | B1 * | 3/2005 | Whitehouse et al. | 250/288 |
| 6,906,322 | B2 * | 6/2005 | Berggren et al. | 250/288 |
| 7,214,320 | B1 * | 5/2007 | Gregori et al. | 210/656 |
| 7,223,966 | B2 | 5/2007 | Weiss et al. | |
| 7,355,169 | B2 * | 4/2008 | McLuckey et al. | 250/282 |
| 7,397,027 | B2 * | 7/2008 | Li | 250/287 |
| 7,564,026 | B2 | 7/2009 | Vestal | |
| 7,564,028 | B2 | 7/2009 | Vestal | |
| 7,589,319 | B2 | 9/2009 | Vestal | |
| 7,663,100 | B2 | 2/2010 | Vestal | |
| 2002/0158194 | A1 | 10/2002 | Vestal et al. | |
| 2002/0195356 | A1 * | 12/2002 | Huang | 206/312 |
| 2003/0141447 | A1 | 7/2003 | Verentchikov et al. | |
| 2004/0222369 | A1 * | 11/2004 | Makarov et al. | 250/281 |
| 2005/0116162 | A1 | 6/2005 | Vestal | |
| 2005/0269505 | A1 | 12/2005 | Ermer | |
| 2005/0279933 | A1 | 12/2005 | Appelhans et al. | |
| 2008/0128611 | A1 * | 6/2008 | McLuckey et al. | 250/283 |
| 2008/0272291 | A1 | 11/2008 | Vestal | |
| 2008/0272298 | A1 * | 11/2008 | Kim | 250/310 |
| 2009/0072133 | A1 * | 3/2009 | Schultz et al. | 250/282 |
| 2009/0294658 | A1 | 12/2009 | Vestal et al. | |
| 2010/0181473 | A1 | 7/2010 | Blenkinsopp et al. | |

FOREIGN PATENT DOCUMENTS

WO WO 2006064280 A2 * 6/2006

OTHER PUBLICATIONS

Beavis, Ronald C., et al., Factors Affecting the Ultraviolet Laser Desorption of Properties, Rapid Communications in Mass Spectrometry, 1989, pp. 233-237, vol. 3 No. 9, Heyden & Son Limited.

Bergmann, T., et al., High-Resolution Time-Of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-Of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-Of-Flight Mass Spectrometer for the Simultaneous Focusing of Metastable Product Ions, Rapid Communication in Mass Spectrometry, 1994 pp. 781-785, vol. 8, John Wiley & Sons.

Cornish, Timothy J., et al., Tandem Time-Of-Flight Mass Spectrometer, Analytical Chemistry, Apr. 15, 1993, pp. 1043-1047, vol. 65, No. 8.

Hillenkamp, F., Laser Desorption Mass Spectrometry: Mechanisms, Techniques and Applications, 1989, pp. 354-362, vol. 11A, Heyden & Son, London.

Kaufmann, R., et al., Mass Spectrometric Sequencing of Linear Peptides by Product-Ion Analysis in a Reflectron Time-Of-Flight Mass Spectrometer Using Matrix Assisted Laser Desorption Ionization, Rapid Communications in Mass Spectrometry, 1993, pp. 902-910, vol. 7, John Wiley & Sons, Ltd.

Mamyrin, B.A. et al., The Mass-Reflectron, A New Nonmagnetic Time-Of-Flight Mass Spectrometer With High Resolution, Sov. Phys. 1973, pp. 45-48, vol. 37, No. 1, American Institute of Physics.

Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.

Neuser, H. J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.

Vestal, M. L., et al., Delayed Extraction Matrix-Assisted Laser Desorption Time-Of-Flight Mass Spectrometry, Rapid Communications in Mass Spectrometry, 1995, pp. 1044-1050, vol. 9, John Wiley & Sons, Ltd.

Vestal, M. L., et al., Resolution and Mass Accuracy in Matrix Accuracy in Matrix-Assisted Laser Desorption Ionization-Time-Of-Flight, American Society for Mass Spectrometry, 1998, pp. 892-911, Elsevier Science, Inc.

Vestal, M., High Performance MALDI-TOF Mass Spectrometry for Proteomics, International Journal of Mass Spectrometry, 2007, pp. 83-92.

Wiley, W. C., et al., Time-Of-Flight Mass Spectrometer With Improved Resolution, The Review of Scientific Instruments, Dec. 1955, pp. 1150-1157, vol. 26, No. 13.

Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.

"Notification of Transmittal of The International Search Report and The Written Opinion of The International Searching Authority, or The Declaration" For PCT/US2010/022122, Aug. 16, 2010, 9 pages, International Searching Authority, Korean Intellectual Property Office, Seo-gu, Daejeon, Republic of Korea.

"Notification of Transmittal of The International Search Report and The Written Opinion of The International Searching Authority, or The Declaration" For PCT/US2010/060902, Aug. 29, 2011, 10 pages, International Searching Authority/Korean Intellectual Property Office, Seo-gu, Daejeon, Republic of Korea.

"Notification Concerning Transmittal of International Preliminary Report on Patentability (Chapter I of the Patent Cooperation Treaty" For PCT/US2010/046074, Mar. 8, 2012, 5 pages, The International Bureau of WIPO, Geneva, Switzerland.

"Notification Concerning Transmittal of International Preliminary Report on Patentability (Chapter I of the Patent Cooperation Treaty" For PCT/US2010/060902, Jul. 12, 2012, 7 pages, The International Bureau of WIPO, Geneva, Switzerland.

"Notification of Transmittal of The International Search Report and The Written Opinion of The International Searching Authority, or The Declaration" For PCT/US2011/063855, Jul. 27, 2012, 11 pgs., International Searching Authority/Korea, Korean Intellectual Property Office, Daejeon Metropolitan City, Republic of Korea.

"Notification of Transmittal of the International Search Report and the Written Opinion of the International Searching Authority, or the Declaration" for PCT/US2012/025761, Sep. 25, 2012, 9 pages, International Searching Authority/KR, Daejeon Metropolitan City, Republic of Korea.

* cited by examiner

MERGED ION BEAM TANDEM TOF-TOF MASS SPECTROMETER

The section headings used herein are for organizational purposes only and should not to be construed as limiting the subject matter described in the present application in any way.

Introduction

Many mass spectrometer applications require an accurate determination of molecular masses and relative intensities of metabolites, peptides, and intact proteins in complex mixtures. Tandem time-of-flight (TOF) mass spectrometry provides information on the structure and sequence of many biological polymers and allows unknown samples to be accurately identified. Tandem TOF mass spectrometers employ a first TOF mass analyzer to produce, separate, and select a precursor ion, and a second mass analyzer to fragment the selected ions and record the fragment mass spectrum from the selected precursor. A wide variety of tandem mass spectrometry using various mass analyzers and combinations thereof are known in the literature.

Matrix-assisted laser desorption/ionization time-of-flight (MALDI-TOF) mass spectrometry is a well established method for determining molecular mass of peptides and proteins. Several approaches to matrix assisted laser desorption/ionization (MALDI)-TOF MS-MS are described in the prior art. All of these approaches are based on the observation that at least a portion of the ions produced in the MALDI ion source fragment as they travel through a field-free region. Ions may be energized and fragmented as a result of excess energy acquired during the initial laser desorption process, or by energetic collisions with neutral molecules in the plume produced by laser radiation, or by collisions with neutral gas molecules in the field-free drift region.

These fragment ions travel through the drift region with approximately the same velocity as the precursor, but their kinetic energy is reduced in proportion to the mass of the neutral fragment that is lost. A timed-ion-selector may be placed in the drift space to transmit a small range of selected ions and to reject all others. In a TOF mass analyzer employing a reflector, the lower energy fragment ions penetrate less deeply into the reflector and, consequently, arrive at the detector earlier in time than the corresponding precursors. Conventional reflectors focus ions in time over a relatively narrow range of kinetic energies. Thus, only a small mass range of fragments are focused for given potentials applied to the reflector.

The use of electrospray ionization (ESI) and matrix-assisted laser desorption/ionization (MALDI) has revolutionized applications of mass spectrometry to biology. It is generally accepted that functional genomics, proteomics, and metabolomics will eventually provide new technologies that will revolutionize diagnosis and treatment of disease. The human genome project has established the molecular approach to understanding biology, but present knowledge of how an organism functions at the molecular level is poor. Functional analyses must be carried out, not only at the level of gene expression (transcriptomics), but also at the level of protein translation and modification (proteomics), and at the level of the metabolite network (metabolomics). A major research effort in mass spectrometry and related disciplines has been expended over the past several years toward reaching these goals, and enormous progress has been made.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teachings in any way.

DESCRIPTION OF VARIOUS EMBODIMENTS

Figure 1:
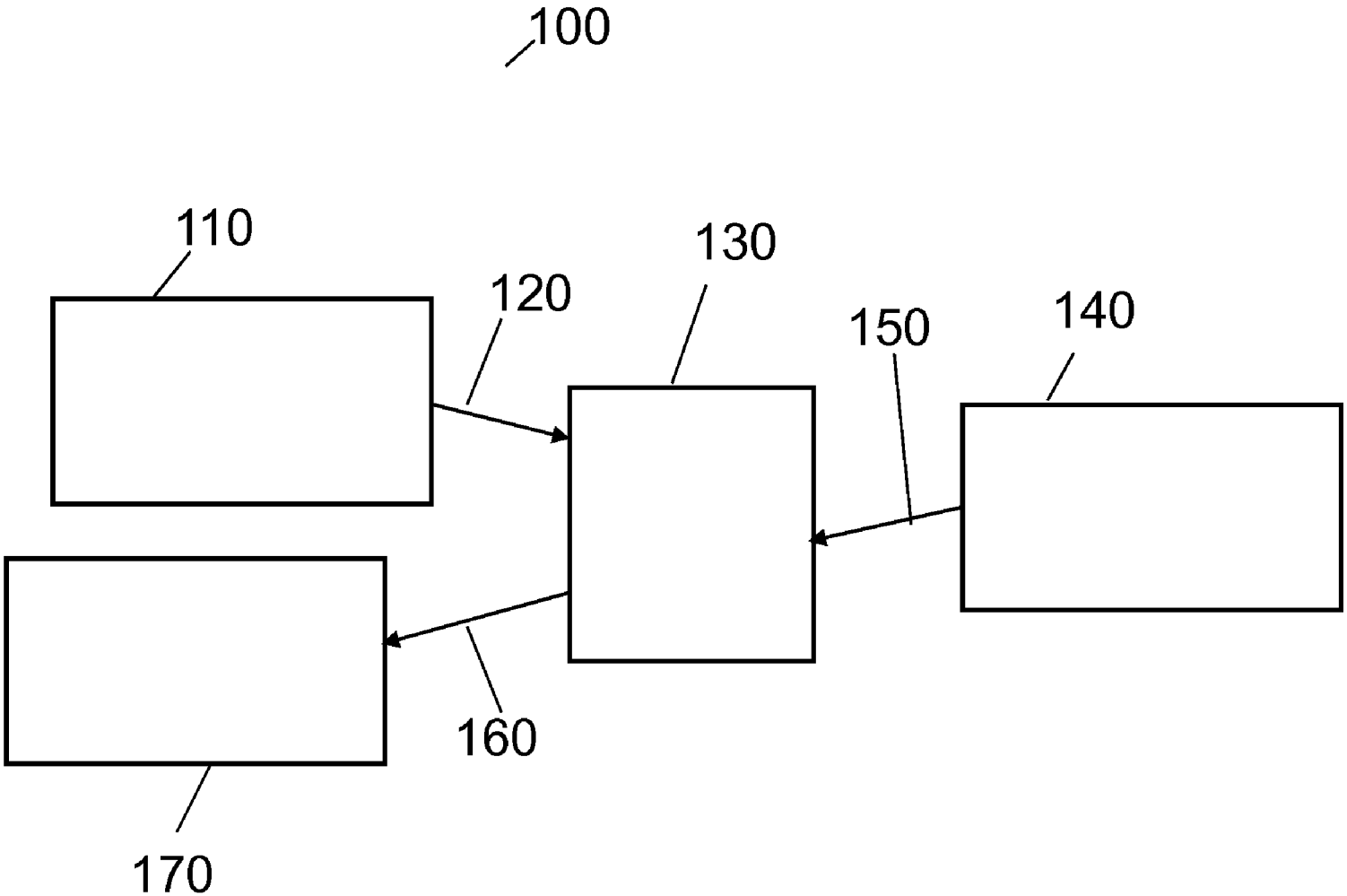
FIG. 1 illustrates a block diagram of one embodiment of a merged ion beam tandem TOF-TOF mass spectrometry according to the present teaching.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

Presently available methods of mass spectrometry are still too slow and cumbersome to achieve the desired goals of functional genomics, proteomics, and metabolomics for applications, such as diagnosis and treatment of disease. Many spectrometers used for these application use electrospray ionization. The speed and capacity of these spectrometers integrated with separation, such as liquid chromatography mass spectrometry (LC-MS-MS), have been dictated by limitations of the electrospray ionization rather than the properties of the sample. Also, the dynamic range of these spectrometers is insufficient for many complex samples.

Known MALDI-TOF tandem mass spectrometry is not capable of determining amino acid sequences of large peptides and proteins. Both hybrid quadrupole-quadrupole time-of-flight (QqTOF) and TOF-TOF instruments provide sequence information using either collision-activated dissociation (CAD) or unimolecular dissociation following excitation in the ion source, such as post-source dissociation (PSD). However, these techniques are relatively ineffective for ions with masses greater than ca. 3 kDa. Even for relatively low mass peptides, these mass spectrometry techniques often yield incomplete and sometimes ambiguous information about the structure.

MALDI-TOF mass spectrometry with in-source dissociation (ISD) has demonstrated fragmentation of intact proteins that is similar to that observed with electron transfer dissociation (ETD) following electrospray ionization, even for very large proteins. However, the sensitivity for ISD is relatively poor so purified proteins are required since there is no possibility for precursor selection. MALDI-TOF MS-MS with either unimolecular fragmentation following excitation in the ion source or with collision-induced fragmentation in the field-free flight path generally produces useful fragment spectra at m/z values below 3 kDa. However, at higher mass, the spectra are of very limited utility. In some cases, it is possible to infer complete sequence de novo from the fragment spectrum, but generally matching with a database is required to interpret spectra.

There are several other known methods employing electrospray ionization for analyzing large peptides and proteins that have various advantages and limitations. For example, a method for peptide/protein fragmentation using electron capture dissociation (ECD) was first described in R. A. Zubarev et al., "Electron Capture Dissociation of Multiply Charged Protein Cations A Nonergodic Process", J. Am. Chem. Soc. 120, 3265-3266 (1998). In this method, multiply-charged peptides or proteins are reacted with thermal electrons confined in the magnetic field of a Fourier transform ion cyclotron resonance (FTICR) mass spectrometer. Thermal electron capture by a protonated peptide is exoergic by about 6 eV and thus causes rapid fragmentation of the peptide backbone. This fragmentation produces a nearly complete set of c and z-type fragment ions that is independent of the sequence and that preserves post-translational modifications (PTM's). This method if useful for analyzing peptides and proteins by FTICR.

A method of collisionally activating intact protein ions in an ion trap instrument and simplifying the multiply charged fragment spectrum by ion-ion charge reduction reactions has been described in M. He, et al., "Two Ion/Ion Charge Inversion Steps to Form a Doubly Protonated Peptide from a Singly Protonated Peptide in the Gas Phase" J. Am. Chem. Soc. 125, 7756-7757 (2003). Charge inversion reactions have been observed using this method. One feature of this method is that it allows "top-down" analysis of protein structure by measuring product ion masses and charge. However, only a small number of fragments are typically observed, which corresponds to a few weak linkages making identification of the protein and location of post-translational modifications (PTM) difficult.

Another method of analysis that is described in J. E. P. Syka, J. J. Coon, M. J. Schroeder, J. Shabanowitz, D. F. Hunt, "Peptide and protein sequence analysis by electron transfer dissociation mass spectrometry" Proc. Nat. Acad. Sci. USA 101, 9528-9533 (2004) uses ion-ion reactions in a quadrupole ion trap. The method uses electron transfer reactions to perform electron transfer dissociation between an anion with relatively low electron affinity and a multiply-charged peptide to produce similar fragmentation as observed with ECD. More specifically, multiply charged protein ions are produced by electrospray and allowed to react with fluoranthene radical anions. Electron transfer to the multiply charged protein is highly exoergic and promotes random dissociation of the N—Cα bonds of the protein backbone to produce c- and z-type fragment ions. Fragment ions are then deprotonated in a second ion-ion reaction with the carbozylate anion of benzoic acid, producing singly and doubly charged fragment ions that typically characterize 15-40 amino acids at both the N and C terminal of the protein.

Research using electrospray has shown that ETD produces spectra that are relatively easy to interpret de novo, and post-translational modifications can be detected and identified. At masses greater than 3 kDa, most peptides yield significant intensities of doubly charged ions with MALDI, and for higher mass proteins (e.g. BSA) the doubly charged intensity is greater than the singly charged. Several higher charge states are also observed. All of the peptides and proteins studied by MALDI-TOF with in-source dissociation (ISD) produce significant intensities of doubly charged ions in the MS spectra and the ISD spectra provide nearly complete structural information similar to that observed with ETD.

Other researchers have studied neutralization/re-ionization collision processes employing high energy ion beams colliding with neutrals in a sector-field MS-MS instrument. See, for example, C. Wesdemiotis and F. W. McLafferty, "Neutralization-Reionization Mass Spectrometry", Chem. Rev. 87, 485-500 (1987). This research, however, did not include measurements of ion-ion collision processes under single collision conditions involving high mass analytes with detection and analysis of the resulting fragmentation.

One aspect of the present teaching is that electron transfer can be utilized between negative ions and multiply charged positive ions to provide unambiguous sequence information on peptides and proteins. Methods according to the present teaching provide sensitive measurements of reactions between ions of opposite polarity and between ions and excited neutrals at relatively low translational energies. The internal temperature (or excitation) of the reactants may be relatively high but the translational temperatures are very low leading to very high cross sections for these processes. For example, collisions with reduced mass of 100 Da and relative velocity of 1 m/s correspond to translational energy of 5×10-7 eV, and translational temperature of 6×10-3 K.

The present teaching relates to rapidly and accurately determining mass-to-charge ratios of fragment ions produced by ion-ion collisions between positive and negative ions produced by a pulsed ionization source. The methods and apparatus of the present teaching provide the ability to analyze ion-ion collision processes under single collision conditions with direct measurement of charge transfer and fragmentation. Furthermore, the methods of the present teaching provide a practical technique for determining molecular structure of singly and doubly charged molecular ions produced by MALDI using ion-ion and ion-excited neutral collisions to determine molecular structure.

The methods are versatile and can be applied to all ions produced by MALDI including intact proteins. The methods can provide relatively high speed and high sensitivity and can be used for identification and structural elucidation of unknown samples that is more accurate than known methods using electrospray ionization and ion traps. Some of the present specification relates to analyzing singly and doubly charged analyte ions that are produced by MALDI. However, one skilled in the art will appreciate that the present teaching relates to analyzing all types of molecules that are amenable to MALDI ionization including without limitations metabolites, lipids, oligosaccharides, glycoconjugates, oligonucleotides, peptides, and intact proteins.

In one embodiment of the present teaching, a spectrometer according to the present invention includes two pulsed ion sources and ion optics that are designed so that beams from the two pulsed ion sources are merged within the collision region. The pulses applied to each of the two pulsed ion sources are accurately synchronized in time, and the relative velocity of the beams is accurately determined. For collisions between positive and negative ions, the relative velocity can be set at a level that is very close to zero.

FIG. 1 illustrates a block diagram of a merged ion beam tandem TOF-TOF mass spectrometer 100 according to the present teaching. The mass spectrometer 100 includes a first pulsed ion source 110 that produces a first pulsed ion beam 120 of precursor ions having a first predetermined mass-to-charge ratio, charge and velocity. An ion mirror 130 is positioned in the path of the first pulsed ion beam 120 of precursor ions. The ion mirror 130 generates a reflected beam 160 that is directed to a TOF mass analyzer 170.

A second pulsed ion source 140 produces a second pulsed ion beam 150 of precursor ions having a second predetermined mass-to-charge ratio, but having a charge with an opposite polarity to the charge of the precursor ions in the first pulsed ion beam 120. In many embodiments, the second pulsed ion source 140 generates the second pulsed beam with a velocity that is substantially equal to the velocity of first pulsed beam 120. The second pulsed ion beam 150 is then transmitted through ion mirror 130, where it experiences only minimally deflection because the polarity of the ions in the first and second pulsed beams is opposite.

The first and second pulsed ion source 110, 140 are synchronized so that the first and second pulsed ion beams 120, 150 are synchronized in time and space. Consequently, a merged ion beam 160 is formed that includes ions of opposite polarity that are in close proximity to each other with a very small relative velocity. Fragment ions of predetermined charge that are produced as the result of ion-ion collision processes in the merged ion beam 160 are directed to the TOF mass analyzer 170. The mass-to-charge ratio values for fragments are then measured to produce a fragment ion mass spectrum.

Figure 2:
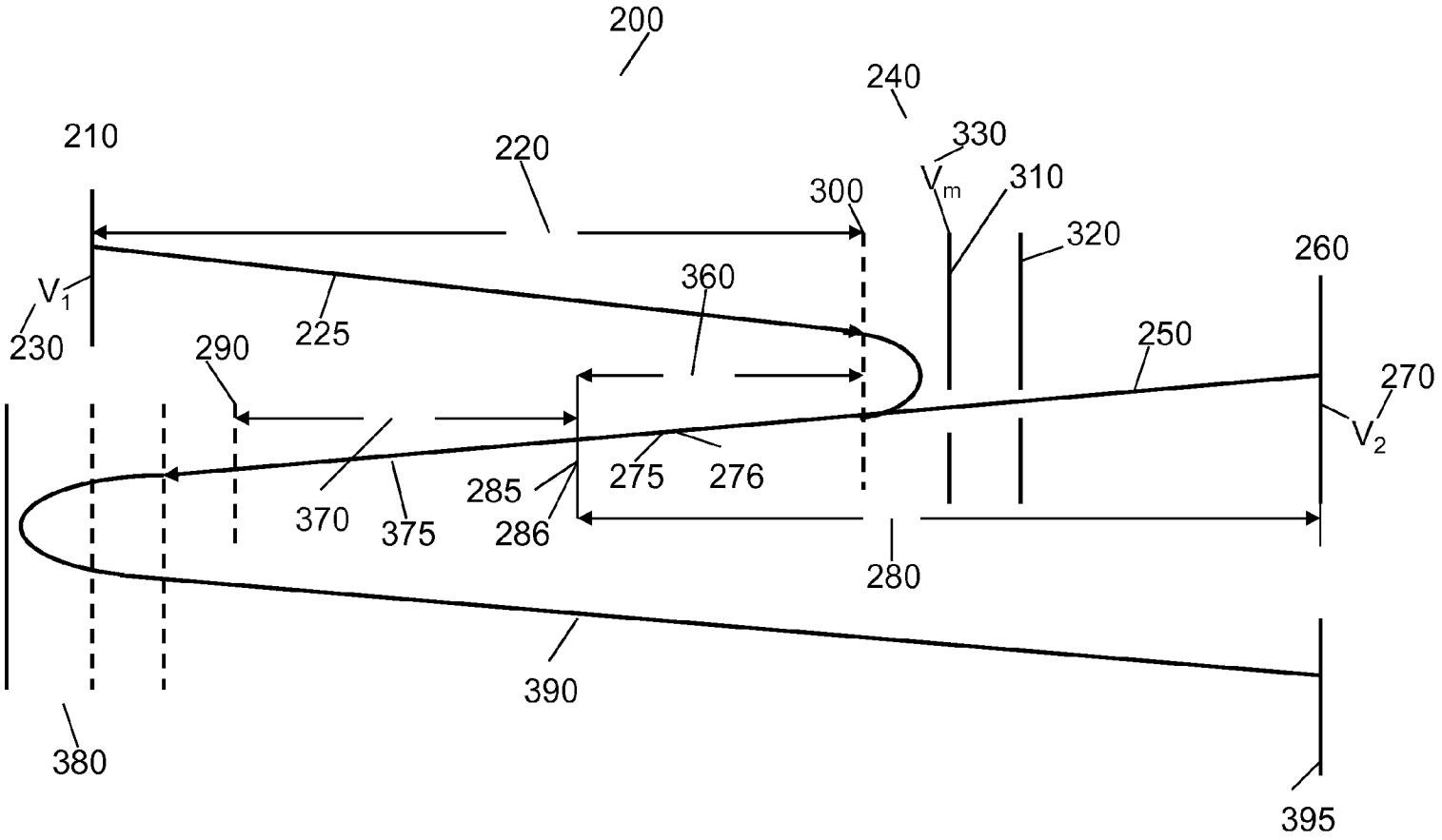
FIG. 2 illustrates an ion path diagram for a merged ion beam tandem TOF-TOF mass spectrometer according to the present teaching.

FIG. 2 illustrates an ion path diagram 200 for a merged ion beam tandem TOF-TOF mass spectrometer 100 according to the present teaching. A first pulsed ion source 210 produces ions in a first pulsed ion beam 225 with accelerating potential $V_1$ 230. The first pulsed ion beam 225 is focused at a first mirror grid 300 that is located at an effective distance 220 from first pulsed ion source 210.

A first ion mirror 240 is positioned in the path of the first pulsed ion beam 225. The first ion mirror 240 includes a first ion mirror grid 300 that is maintained at ground potential. A second ion mirror plate 310 is maintained at potential $V_m$ 330. A third ion mirror plate 320 is maintained at ground potential. The potential of the second ion mirror plate 310 $V_m$ 330 is the same polarity as the accelerating potential $V_1$ 230. However, the magnitude of the potential of the second ion mirror plate 310 $V_m$ 330 is chosen to be larger than the magnitude of the accelerating potential $V_1$ 230 so that ions in the pulsed ion beam 225 that enter the first mirror 240 are reflected and then directed to the trajectory 275. The ions in the pulsed ion beam 225 are then refocused at a position 285 that is at an effective distance 360 from first mirror grid plate 300.

A second pulsed ion source 260 produces ions in a second pulsed ion beam 250 with an accelerating potential $V_2$ 270. The accelerating potential $V_2$ 270 is opposite in polarity to the accelerating potential $V_1$ 230 and opposite in polarity to the potential of the second ion mirror plate 310 $V_m$ 330. The ions in the second pulsed ion beam 250 are opposite in polarity to the ions in first pulsed ion beam 225. The accelerating potentials $V_1$ 230 and $V_2$ 270 are chosen so that ions of a first predetermined mass-to-charge ratio (m/z) in first pulsed ion beam 225 have a velocity that is substantially equal to the velocity of a second predetermined mass-to-charge ratio in second pulsed ion beam 250.

The first ion mirror 240 is also positioned in the path of the second pulsed ion beam 250. The second pulsed ion beam 250 passes through the first ion mirror 240 and is transmitted along trajectory 276 that substantially coincides with trajectory 275 of the first pulsed ion beam 225. Ions in the second pulsed ion beam 250 are then focused at position 286 that is located at an effective distance 280 from pulsed ion source 260. In the embodiment shown, the focus position 286 is substantially coincident with the focus position 285 where the ions in the pulsed ion beam 225 are refocused.

A time delay between production of the first pulsed ion beam 225 with the first predetermined mass-to-charge ratio and production of the second pulsed ion beam 250 with second predetermined mass-to-charge ratio is chosen so that pulses in the first ion beam 225 arrive at focus position 285/286 at substantially the same time as pulses in the second ion beam 250. In one embodiment, the effective distance 220 along the first ion beam path 225 is substantially equal to the effective distance 280 along the second ion beam path 250. In some embodiments, the time delay between production of the pulse of ions produced in ion source 210 and the production of the pulse of ions produced in ion source 260 is adjusted so that pulses in the first ion beam 225 arrive at focus position 285/286 at substantially the same time as pulses in the second ion beam 250.

Reactions between ions in the first pulsed ion beam 225 and ions in the second pulsed ion beam 250 occur with very large cross sections due to coulombic attraction between ions of opposite polarity. Fragment ions produced along trajectories 275 and 375 between the first mirror grid plate 300 and the third pulsed ion accelerator 290 are accelerated by the pulsed ion accelerator 290. The ions are then reflected by the second ion mirror 380. The fragment ions are separated according to their mass-to-charge ratio as they travel along trajectory 390 and are detected by ion detector 395 to produce a fragment ion mass spectrum. In some embodiments, the polarity of the accelerated fragment ions is the same as the polarity of ions produced in first ion beam 225. In other embodiments, the polarity of the fragment ions is the same as the polarity of ions produced in the second ion beam 250.

Figure 3:
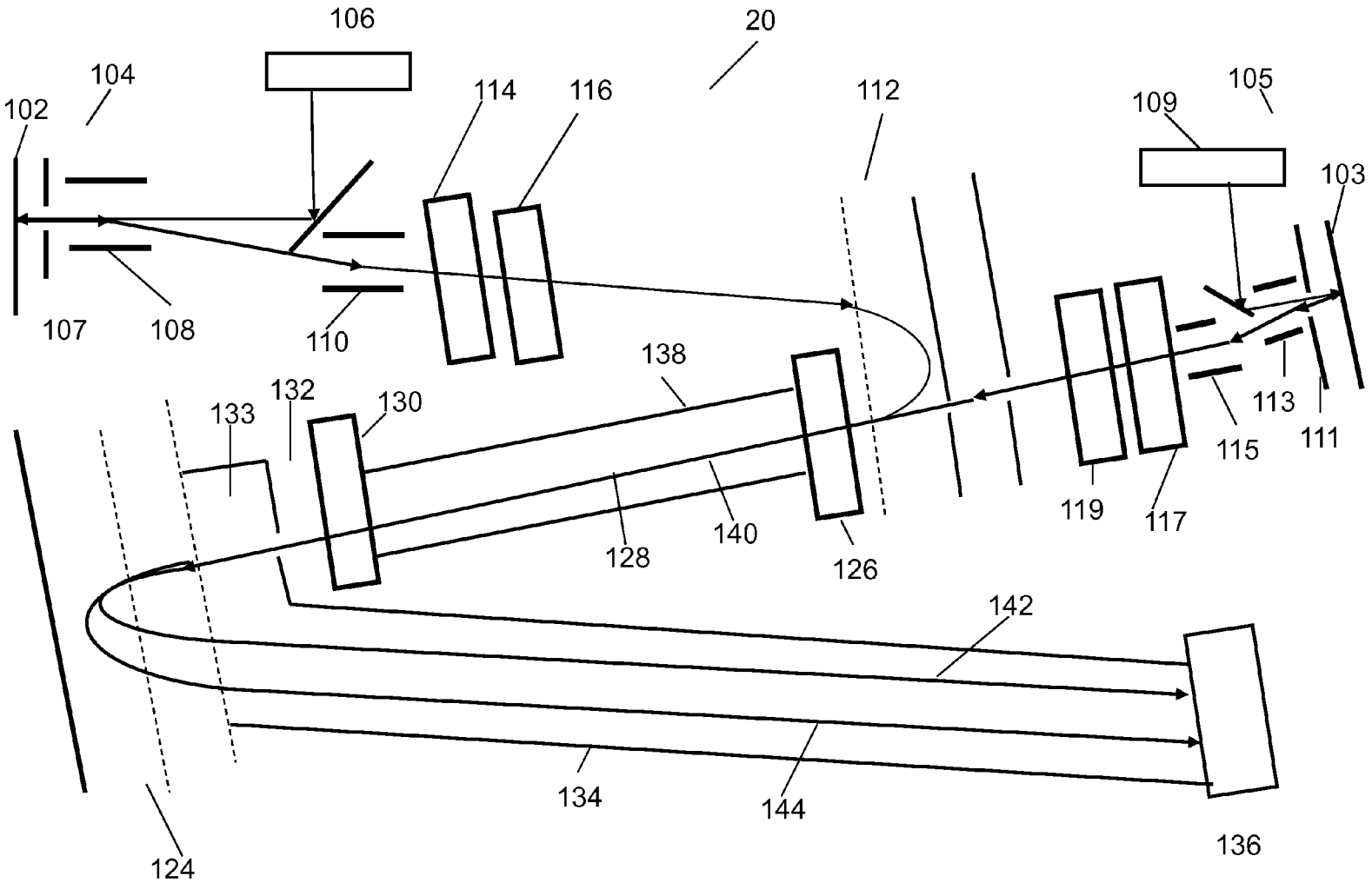
FIG. 3 shows a schematic diagram of one embodiment of a merged ion beam tandem TOF-TOF mass according to the present teaching.

FIG. 3 shows a schematic diagram of a merged beam tandem TOF mass spectrometer 20 according to the present teaching. The mass spectrometer 20 includes a sample plate 102 that is installed on a precision x-y table that moves to allow a laser beam to raster over the sample plate 102 at any speed. For example, in one specific embodiment, the laser beam rasters over the sample plate 102 at speeds up to about 20 mm/sec, but higher raster speeds are possible. The source vacuum housing (not shown) contains the mass spectrometer 20. In many practical systems, the source vacuum housing includes a means for quickly changing the sample plate 102 without venting the system.

A first laser desorption pulsed ion source 104 is positioned to launch a first pulsed ion beam into the mass spectrometer 20. In one embodiment, the pulsed ion source 104 comprises a two-field pulsed ion source. One skilled in the art will appreciate that numerous types of pulsed ion sources can be used. The pulsed ion source 104 shown in FIG. 3 includes a laser 106 that irradiates a sample positioned on the sample plate 102 to generate ions. For example, one suitable laser 106 is a frequency tripled Nd:YLF laser operating at 5 kHz. In some embodiments, the pulsed ion source 104 comprises a matrix-assisted laser desorption/ionization (MALDI) pulsed ion source. However, it should be understood that non-MALDI pulsed ion sources can be used with the mass spectrometer of the present teaching.

Ion source optics are positioned after the first pulsed ion source 104. The ion source optics are designed for high-resolution mass spectra measurements. An extraction electrode 107 is positioned adjacent to the sample plate 102. A first timed ion selector 114 is positioned after the pulsed ion source 104 in the path of the ion beam. A first 108 and a second ion deflector 110 are positioned after ion source 104 in the path of the ion beam. The first and second ion deflectors 108, 110 deflect the ion beam to a first timed ion selector 114 positioned proximate to the output of the second ion deflector 110.

In some embodiments, the first timed ion selector 114 is positioned in the path of the ion beam in the space between the second ion deflector 110 and a first pulsed ion accelerator 116 as depicted in FIG. 3. In other embodiments, the first timed ion selector 114 is positioned in the path of the ion beam between the first ion deflector 108 and second ion deflector 110. The first timed ion selector 114 transmits ions of predetermined mass-to-charge ratio and deflects all other ions away from the entrance to a first ion mirror 112.

A first pulsed ion accelerator 116 is positioned adjacent to the first timed ion selector 114. The first pulsed ion accelerator 116 directs accelerated ions to the first ion mirror 112 where the ions are reflected and focused. The polarities of these voltages are chosen to accelerate fragment ions of the desired polarity. In some embodiments, the first timed ion selector 114 is positioned in the ion path before the first ion accelerator 116 as shown in FIG. 3. However, in other embodiments, the first timed ion selector 114 is positioned after the first pulsed ion accelerator 116.

The voltage applied to the ion mirror 112 can be adjusted to time-focus ions travelling from a focal point at the first timed ion selector 114 to the ion detector 136. This allows measurement of complete MS spectra from either source with high resolving power and mass accuracy. Positive or negative ions can be measured depending on the polarity of the applied voltage.

In some embodiments, the mass spectrometer 20 includes a second laser desorption pulsed ion source 105. In one embodiment, the pulsed ion source 105 comprises a two-field pulsed ion source. However, one skilled in the art will appreciate that any type of pulsed ion source can be used. The pulsed ion source 105 includes a laser 109 that irradiates a sample positioned on a sample plate 103 to generate ions. For example, one suitable laser 109 is a frequency tripled Nd:YLF laser operating at 5 kHz. In some embodiments, the pulsed ion source 105 comprises a matrix-assisted laser desorption/ionization (MALDI) pulsed ion source. However, it should be understood that non-MALDI pulsed ion sources can be used with the mass spectrometer of the present teaching.

Ion source optics are positioned after the second pulsed ion source 105. The ion source optics are designed for high-resolution mass spectra measurements. An extraction electrode 111 is positioned adjacent to the sample plate 103. A second timed ion selector 117 is positioned after the pulsed ion source 105 in the path of the ion beam. A third 113 and a fourth ion deflector 115 are positioned after ion source 105 in the path of the ion beam. The third and fourth ion deflectors 113, 115 deflect the ion beam to the second timed ion selector 117 positioned proximate to the output of the fourth ion deflector 115.

In some embodiments, the second timed ion selector 117 is positioned in the path of the ion beam in the space between the fourth ion deflector 115 and a second pulsed ion accelerator 119 as shown in FIG. 3. In other embodiments, the second timed ion selector 117 is positioned in the path of the ion beam between the third ion deflector 113 and the fourth ion deflector 115. A second pulsed ion accelerator 119 is positioned adjacent to the second timed ion selector 117 to direct accelerated ions through the ion mirror 112 along the trajectory 140 that coincides with the trajectory of ions produced in first pulsed ion source 104 and reflected by the ion mirror 112. The second timed ion selector 117 transmits ions of predetermined mass-to-charge ratio and deflects all other ions away. In some embodiments, the second timed ion selector 117 is positioned in the ion path before the second ion accelerator 119 as shown in FIG. 3. In other embodiments, the second timed ion selector 117 is positioned after the second pulsed ion accelerator 119.

In some embodiments, a third timed ion selector 126 is positioned in the field-free space after the output of the first ion mirror 112. In one embodiment, the third timed ion selector 126 is a Bradbury-Nielsen type ion shutter or gate. A Bradbury-Nielsen type ion shutter or ion gate is an electrically activated ion gate. Bradbury-Nielsen timed ion selectors include parallel wires that are positioned orthogonal to the path of the ion beam. High-frequency voltage waveforms of opposite polarity are applied to alternate wires in the ion gate. The ion gates only pass charged particles at certain times in the waveform's cycle when the voltage difference between wires is near zero. At other times, the ion beam is deflected to some angle by the potential difference established between the neighboring wires. The wires are oriented so that ions rejected by the timed ion selector 126 are deflected away from ion beam trajectory 140.

In many embodiments, operating conditions are chosen so that pulses of ions of a first predetermined mass-to-charge ratio and polarity produced by the first pulsed ion source 104 arrive at a predetermined point 128 in the field-free region 138 at substantially the same time as pulses of ions of a second predetermined mass-to-charge ratio and polarity opposite to the polarity of the ions produced by the first pulsed ion source 104. In addition, in many embodiments, the operating conditions are chosen so that the relative velocity between ions of opposite charge is substantially zero in the field-free region 138. The pulses of ions containing ions of opposite charge travel through the field-free region 138. The probability for ion-ion collisions and subsequent fragmentation is very large due to the coulombic attraction between ions of opposite polarity and the very small relative velocity between the ions of opposite polarity.

A third pulsed ion accelerator 130 is positioned to receive precursor ions and fragment ions produced in the field-free region 138 by ion-ion reactions as pulses of precursor ions travel between the exit of the first ion mirror 112 and the entrance of the third pulsed ion accelerator 130. In one embodiment, the third pulsed ion accelerator 130 is activated to further accelerate the ions and fragments thereof. In one embodiment accelerated ions are further accelerated by a static electric field in region 132.

A second ion mirror 124 is positioned after the pulsed ion accelerator 130 and the first electric field-free region 133. An ion detector 136 is positioned after the second ion mirror 124 in a second electric field-free region 134. The second ion mirror 124 is positioned such that ions reflected by the second ion mirror 124 are focused at the ion detector 136. One skilled in the art will appreciate that numerous types of ion detectors can be used. In one embodiment, the ion detector 136 is a discrete dynode electron multiplier, such as the MagneTOF detector, which is a sub-nanosecond ion detector with high dynamic range. The MagneTOF detector is commercially available from ETP Electron Multipliers.

The ion detector 136 can be coupled to a transient digitizer, which can perform signal averaging and other signal processing. The polarity of the potentials that are applied to the pulsed accelerator 130 and to the ion mirror 124 are chosen to accelerate and focus precursor ions and fragment ions of the desired polarity at the detector 136 so as to produce a spectrum of fragment ions. Lower mass fragment ions have lower kinetic energy because a portion of their energy is lost to the neutral fragment and are consequently reflected along trajectory 142. Higher mass fragment ions lose a smaller amount of energy compared with lower mass fragment ions and are, therefore, transmitted along trajectory 144.

It should be understood by those skilled in the art that the schematic diagram shown in FIG. 3 is only a schematic representation and that various additional elements would be necessary to complete a functional mass spectrometer. For example, power supplies are required to power the pulsed ion sources 104,105, the ion deflectors 108,110, 113, and 115, the timed ion selectors 114, 117, and 126, the first and second ion mirrors 112, 124, the pulsed accelerators 116, 119, and 130, and the detector 126. A multi-channel time delay generator is required to synchronize the pulses from the pulsed ion sources 104,105, the timed ion selectors 114, 117, 126, and the pulsed accelerators 116, 119, and 130. In addition, a vacuum pumping arrangement is required to maintain the operating pressures in the vacuum chamber housing of the mass spectrometer 100 at the desired operating levels.

Figure 4:
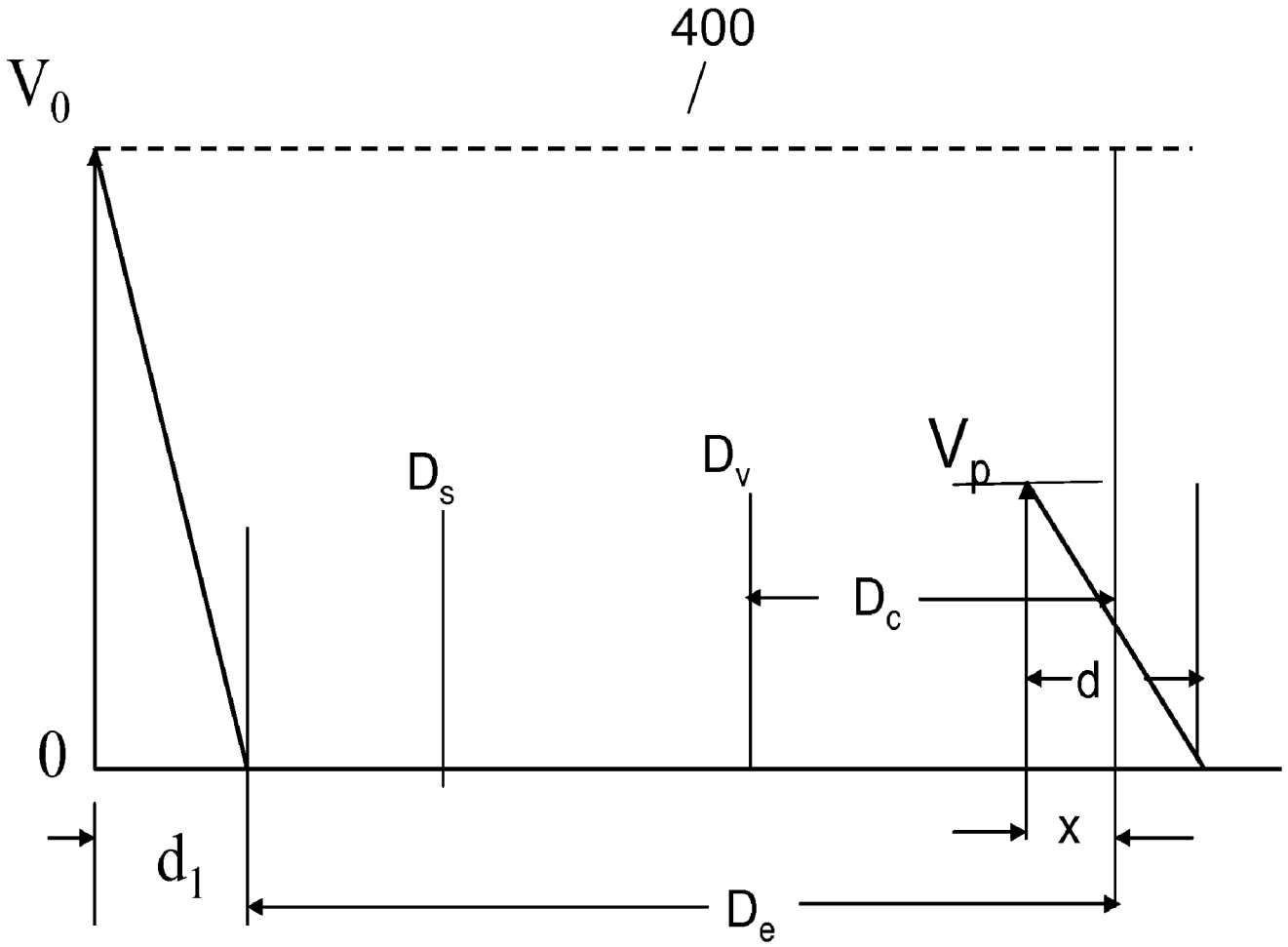
FIG. 4 shows a potential diagram for a pulsed ion source with a pulsed ion accelerator in the ion flight path.

FIG. 4 shows a potential diagram 400 for a pulsed ion source with a pulsed ion accelerator in the ion flight path. One feature of the present teaching is that a pulsed ion accelerator can be positioned in the flight path of the ions, which allows the ions to be refocused at any desired focal point with a substantial narrower velocity distribution. The potential diagram 400 is illustrated for a pulsed ion accelerator located downstream from the ion source for operating conditions where a selected ion with mass $m_0$ reaches the center of the deflector at the time that the accelerating pulse is applied.

An accelerating voltage $V_0$ is applied to the pulsed ion source. The ions generated by the ion source are accelerated over a distance $d_1$. The accelerated ions reach a spatial focal point $D_s$ that corresponds to the point at which the flight time is independent (to first order) of the initial position of the ions at formation. The accelerated ions then reach a velocity focus point $D_v$ that corresponds to the point at which the flight time of an ion of specified mass $m_0$ is independent (to first order) of the initial velocity. In most cases, the initial position x and the initial velocity $v_0$ are independent of each other. Thus, it is not possible to simultaneously minimize the dependence on both the initial position x and on the initial velocity $v_0$. The relative velocity spread after acceleration can be represented by the following equation:

$$(\delta v/v)_v=\delta v_0\Delta t/2d_1=[2d_1/(D_v-D_s)](\delta v_0/v_n)$$

where $\delta v_0$ is the uncertainty in the initial velocity, and $v_n$ is the nominal velocity of an ion with mass m and charge z after acceleration from rest through a potential difference V in the ion source. The nominal velocity can be expressed by the following equation:

$$v_n=(mV/z)^{1/2}.$$

This velocity does not include contributions due to initial velocity or initial position. The contribution to the relative velocity spread due to the initial position is given by $$(\delta v/v)_s=\delta x/2d_1$$

where δx is the uncertainty in the initial position.

The final velocity spread due to these two independent contributions is equal to the square root of the sum of squares of the two contributions. For many practical measurements of interest, the contribution of the spatial distribution is at least an order of magnitude smaller than the contribution due to the velocity spread distribution. Thus, the contribution of the spatial distribution to the overall velocity distribution is often negligible. However, at the position of the velocity focus Dv, the contribution to the time uncertainty may be dominant. Referring to FIG. 4, the relative contribution to peak width Δm/m due to the variation in initial position dx is given by $$R_{s1}=\Delta m/m=2\delta t/t=2[(D_v-D_s)/D_e](\delta x/2d_1)=[(D_v-D_s)/2d_1](2\delta x/D_v)$$

and the corresponding time spread is given by $$\delta t=t[[(D_v-D_s)/D_v](\delta x/2d_1)=([(D_v-D_s)/v_n](\delta x/2d_1)$$

where the flight time t to the velocity focus $D_v$ is equal to $D_v/v_n$. The relative velocity spread at the ion source exit and the time spread at the velocity focus $D_v$ are the most significant variables which determine the overall performance of the instrument. These variables cannot be changed by applying or modifying static electrical fields. In many measurements, the time spread is the major contribution to peak width in the first mass spectrometer section (MS-1) of a tandem mass spectrometer. The relative velocity spread primarily determines the performance of the second mass spectrometer section of a tandem mass spectrometer (MS-2), especially for fragment masses.

A tandem TOF-TOF mass spectrometer according to one aspect the present teachings adjusting the source conditions so that the required performance of both mass analyzers (MS-1 and MS-2) is simultaneously achieved. To achieve these goals, the first ion mirror 112 (FIG. 3) is designed and operated to refocus the ion beam without increasing the other contributions to peak width so that optimal performance can be obtained with practical values of the parameters. The ion source delay time for a single field source can be represented by the following equation:

$$\Delta t=(2d_1)^2/[v_n(D_v-D_s)].$$

The potential diagram 400 represents a single-field source, but a two-field source or any type of source can be used. The pulsed ion accelerator 116 (FIG. 3) is activated when an ion of interest has travelled a distance x further than the entrance to the ion accelerator 116. The variable $D_c$ is the distance from the velocity focus $D_v$ to position x inside the accelerator. The variable $D_e$ is the effective distance from the ion source exit to the position x inside the accelerator. The time for an ion to travel from the source exit to the position x is equal to $D_e/v_n$.

The pulsed ion accelerator is activated when an ion of interest reaches a position x in the accelerator. The kinetic energy after the ion of interest is accelerated by the pulsed ion accelerator can be represented by the following equation:

$$T_2=zV_a(1+q)\{1+[(q-D_c/2d)/(1+q)](\delta V_0/V_0)\}=zV_a(1+q)(1+p_2)=z(V_0+V_a)(1+p_2) \text{ where}$$

$$q=V_0/V_a;$$

$$V_a=V_p(x/d);$$

$$p_2=[(q-D_c/2d)/(1+q)](\delta V_0/V_0)=[(V_a/(V_0+V_a)][V_0/V_a-D_c/2d]p_1;$$

$$p_1=(\delta V_0/V_0);\text{ and}$$

If q, the ratio $V_0/V_a$, is chosen to be equal to the ratio $D_c/2d$, then $p_2=0$ and the velocity spread for the selected ion is removed. Therefore, the condition for refocusing the beam at a distance D is given by $$D=D_c(-p_1/p_2)(1+V_a/V_0)^{1/2}$$

For example, for D=800 mm and for the following other parameters d=6, $D_c$=50 mm, $V_a/V_0$=0.26 and $p_2/p_1$=−0.07. Thus, the velocity spread is reduced by about a factor of 14 under these conditions.

Figure 5:
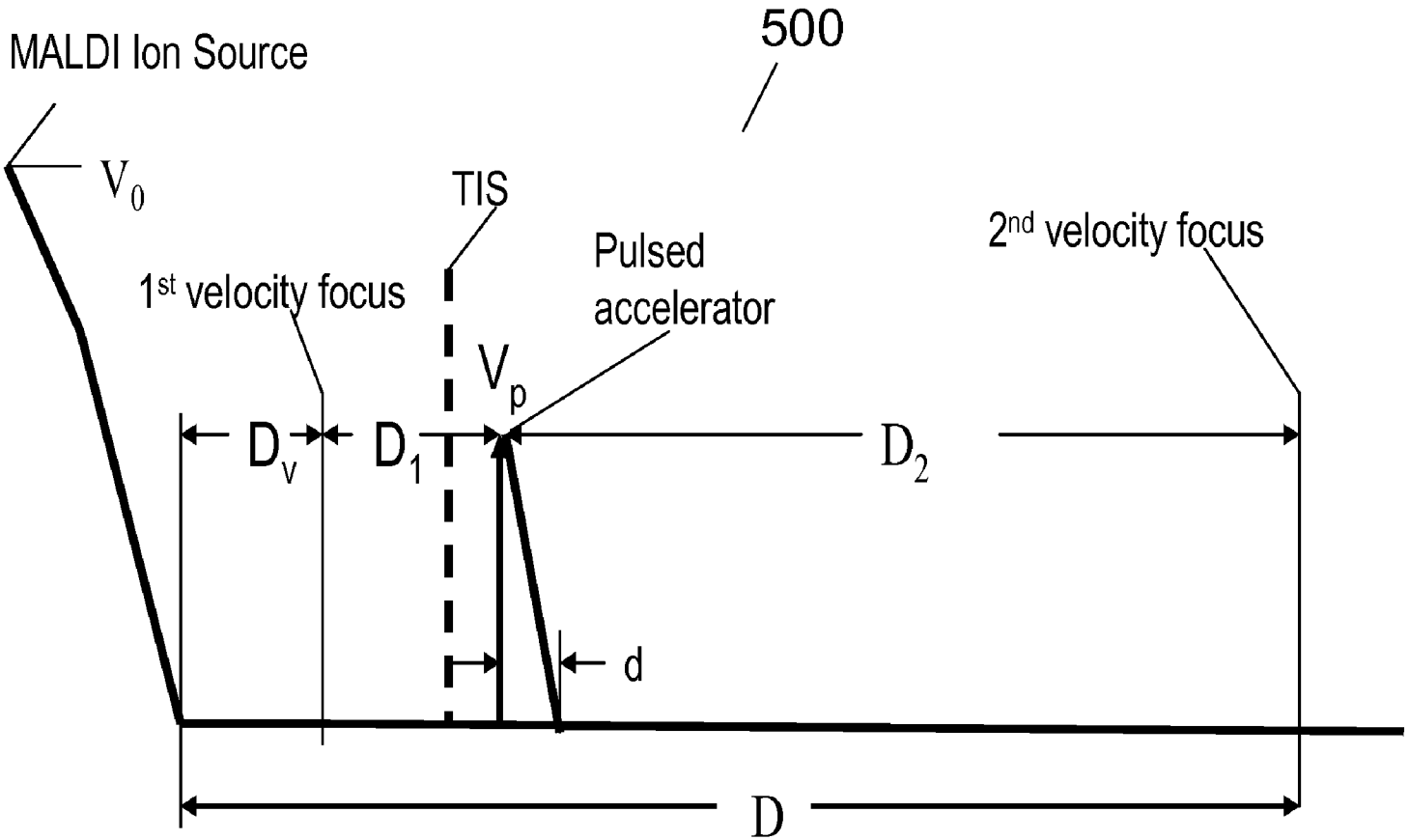
FIG. 5 shows a potential diagram for a first mass analyzer for a merged ion beam tandem TOF-TOF according to the present teaching.

FIG. 5 shows a potential diagram 500 for a first mass analyzer for a merged beam tandem TOF-TOF according to the present teaching. The potential diagram is representative of both ion sources 104, 105 in the tandem mass spectrometer 20 shown in FIG. 3. The ion optics for the first pulsed ion source also includes a single-stage ion mirror, which is not shown. A two-stage ion mirror is not necessary in many practical instruments because the ion velocity spread is relatively small. Parameters are chosen so that ions produced by the second ion source 105 (FIG. 3) are focused at the second velocity focus point. Ions from the first pulsed ion source 104 (FIG. 3) are then focused at the entrance to the ion mirror and are then refocused at the second velocity focus point where the ions from the second pulsed ion source are focused.

Referring to the potential diagrams 400 and 500 shown in FIGS. 4 and 5, an example is presented for a doubly charged ion from a 30 kDa protein with 15 kV acceleration voltage, or equivalently a singly charged ion of mass 200 Da with 200 V acceleration. Typical values for the distance parameters are $d_1$=12.5 mm, $D_s$=25 mm, $D_v$=75 mm, $D_1$=50 mm, d=6 mm, $D_2$=850 mm, and Δx=0.01 mm. At high mass, zV/m is approximately unity. Thus, the nominal velocity $v_n$ of an ion with mass m and charge z after acceleration from rest through a potential difference V in the ion source is equal to 0.0139 mm/ns (13,900 m/s). The ion source delay time Δt is equal to 900 ns and the initial velocity spread $\delta v_0$ is equal to $4\times10^{-4}$ mm/ns. The pulsed ion accelerator reduces the velocity spread by about a factor of 14. Thus, the peak width at the focus is 1.4 ns with a velocity spread of 14 m/s.

The methods and apparatus of the present teaching that use a merged ion beam will result in much higher sensitivity and high resolution precursor selection compared with the known methods. Thus, the methods and apparatus of the present teaching can provide complete sequence information of intact proteins without digestion. One skilled in the art will appreciate that the methods and apparatus of the present invention can be applied to measuring singly-charged ions but requires a double charge transfer process for detection of fragments. The double charge transfer process can reduce the efficiency of the fragmentation process, but the signal-to-noise level is relatively high even though when the absolute intensity is relatively low.

Charge transfer occurs between ions of opposite polarity when pulses of ions containing ions of opposite charge travels through the field-free region 138 (FIG. 3). The coulomb potential for interaction between a positive ion and a negative ion is given by $$V=-(4\pi\epsilon_0)^{-1}(z_1z_2e^2)/r$$

where $\epsilon_0=8.854\times10^{-12}$ farad/meter is the permittivity of free space, $e=1.602\times10^{-19}$ is the magnitude of the electronic charge, r is the distance between the charges (meters), V is the potential energy in joules, and z1 and z2 are the charge numbers which are either one or two depending upon the species being measured. The coulomb potential for interaction between a positive ion and a negative ion with energy in eV and distance in nanometers can be expressed as $$V=-1.44z_1z_2/r$$

The reaction cross section is first determined by conservation of angular momentum which introduces a pseudo potential that can be represented by the following equation:

$$V_c=E(b/r)^2$$

where b is the impact parameter for the collision between two particles and E is the kinetic energy relative to the center of mass. This kinetic energy can be represented by the following equation:

$$E=(m/2)v_r^2$$

where m is the reduced mass and $v_r$ is the relative velocity. The reduced mass m is related to the masses of the colliding particles by the following relationship:

$$m^{-1}=m_1^{-1}+m_2^{-1}$$

If one of the masses is small compared to the other mass, then the reduced mass is nearly equal to the mass of the lighter particle. Expressing the kinetic energy E in eV, the relative velocity $v_r$ in m/s, and the mass in Da results in the following equation for kinetic energy:

$$E=5.181\times10^{-9}mv_r^2$$

Consequently, the motion can be described by a one-dimensional potential that can be expressed by the following equation:

$$V'=E(b/r)^2-1.44z_1z_2/r$$

where the distance between the charges r and the impact parameter b are in nm. A reasonable condition for charge transfer to occur is to require that the distance of closest approach of the charges be less than or equal to some minimum value $r_{min}$. The kinetic energy E can be represented by the following equation:

$$E=V'=E(b/r_{min})^2-(1.44z_1z_2)r_{min}$$

The reaction cross section can then be given by the following equation:

$$\sigma=\pi[r_{min}^2+(2.78\times10^8z_1z_2/mv_r^2)r_{min}]$$

in $nm^2$, for $r_{min}$ in nm, $v_r$ in m/s, and m in Da.

The equation for the reaction cross section implies a very large cross section if the relative velocity is low. The equation predicts an infinite cross section at zero relative velocity. In practice, the interaction time is limited to the range of tens of microseconds. Consequently, the maximum cross section is achieved at relative velocities that are on the order of about 1 m/s. This equation provides the general dependence of the reaction cross section on relative velocity, reduced mass, and charge number of the ions. However, the dependence on exoergicity of the reaction and properties of the reactants is buried in the parameter $r_{min}$.

In some embodiments, the minimum distance of the closest approach may be larger for electron transfer than for proton transfer, but this undoubtedly depends on the energetics of the reaction and sometimes unknown details of the reaction potential surface. This model may be useful for interpreting data on reaction cross sections as a function of relative velocity for proton and electron transfer for various reaction partners. Thus, each reaction may be characterized by a unique value of $r_{min}$ that determines the relative probability of competing reactions as a function of the relative velocity.

A double charge transfer process occurs in the field-free region 138 (FIG. 3) with the ion-neutral collision processes at low relative velocity. The double charge transfer process requires a first reaction between a positive ion and a negative ion to produce an excited neutral as described above. In addition, the double charge transfer process requires a second reaction between an ion and the neutral to re-ionize the neutral and/or its fragments with a charge that is opposite to the charge of the precursor ions. The second reaction occurs at low relative velocity. A model for the second reaction between an ion and the neutral has been described by P. Langevin, Ann. Chim. Phys. 5, 245 (1905). This and other models are described in M. L. Vestal, "Crossed-beam studies of ion-molecule reactions", Ph. D. Dissertation, University of Utah (1975). pp. 15-21.

In this model, the attractive potential can be expressed in the following equation:

$$V=-(4\pi\epsilon_0)^{-1}(\alpha e^2/2r^4)=-9\times10^9(\alpha e^2/2r^4)=-K(\alpha/r^4)$$

where $K=9\times10^9e^2/2=1.15\times10^{-28}$ and $\alpha$ is the polarizability of the neutral reactant. For small relatively rigid molecules, $\alpha$ is approximately $10^{-30}$ $m^3$, and $\alpha$ may be a factor of at least a 100 to 1,000 times larger for larger less rigid and more polarizable molecules. Thus, the motion can be described by the one-dimensional potential $$V'=E(b/r)^2-K\alpha/r^4$$

The effective potential has a maximum at a distance $$r_c=(2K\alpha/Eb^2)^{1/2}$$

If the kinetic energy E is exactly equal to $V^*(r_c)$, then the trajectory becomes a circular orbit of radius $r_c$. The critical impact parameter can then be expressed by the following equation:

$$b_c=(4K\alpha/E)^{1/4}=(8K\alpha/mv_r^2)^{1/4}$$

For impact parameters smaller than $b_c$, the trajectories become spirals into the center until a repulsive or reactive core is encountered. The trajectories spiral back out if no reaction occurs. The reaction cross section from the Langevin theory is as follows:

$$\sigma_L=\pi b_c^2=(\pi/v_r)(8K\alpha/m)^{1/2}=(2.34\times10^{-15}/v_r)(\alpha/m)^{1/2}$$

The reaction cross section is expressed in $m^2$ for $\alpha$ in units of $10^{-30}$ $m^3$, m in Da, and $v_r$ in m/s. The rate constant for ion molecule collisions according to Langevin theory is independent of the relative velocity. The rate constant for the reaction can be represented as the relative velocity multiplied by the cross section and can be expressed by following equations:

$$k=v_r\sigma_L=\pi(8K\alpha/m)^{1/2}=2.34\times10^{-15}(\alpha/m)^{1/2}\text{ in } m^3/s=2.34\times10^{-9}(\alpha/m)^{1/2}\text{ in } cm^3/s.$$

The polarizability is a property of the neutral molecules, and values are typically larger than $10^{-30}$ $m^3$. The approximate rate constant for reactions between singly charged ions of opposite polarity is $$k=1.75\times10^{-9}r_c/(mv_r)\ m^3/s=1.75\times10^{-3}r_c/(mv_r)\ cm^3/s$$
for $r_c$ in nm, $m$ in Da, and $v_r$ in m/s.

At low relative velocities, the reaction between oppositely charged species is much faster than reactions between ions and neutrals. For example, if $\alpha/m=10$ (in the above units), m=100, and $r_c=1$ nm, then the two reaction rates are equal at a relative velocity of 2,360 m/s. At a relative velocity of 1 m/s, the ion-ion reaction is 2,360 times faster than reactions between ions and neutrals according to the Langevin model.

The reaction probability using the methods and apparatus of the present teaching is greatly increased over known methods and apparatus. The general equation for the rate of a bimolecular reaction is given by the following equation:

$$-dn/dt=n_1n_2v_r\sigma=n_1n_2k$$

where $n_1$ and $n_2$ are the concentrations of the reactants. Concentrations of reactants in ion beams can be expressed as n=I/vA where I is the intensity (number/s), v is the velocity, and A the cross sectional area of the ion beam. The relative rate of change of a first species is then given by the following equation:

$$(I_1)^{-1}(dI_1/dt)=(I_2/v_2A)k$$

and the time spent in the reaction chamber is $D_{ec}/v$ where $D_{ec}$ is the effective length of the chamber and v is the larger of $v_1$ and $v_2$. The increase in the reaction rate of first species is obtained by integrating the equation for the relative rate of change of the first species, which can be expressed as the following equation:

$$I_1/I_1^0=\exp[-(I_2D_{ec}/Av^2)k]$$

For one specific mass spectrometer according to the present teaching, the effective length of the chamber $D_{ec}=80$ cm, the cross sectional area of the ion beam A=0.07 $cm^2$, and the velocity $v=1.8\times10^6$ cm/sec. Assuming that the rate constant $k=10^{-5}$ $cm^3/s$, then 1/e of the incident ions of the first species are reacted with an ion beam of the second species with an intensity of $2.8\times10^{14}$ ions/sec.

The duration of each of the pulsed merged ion beams according to the present teaching is relatively short, such as a 5 ns pulse duration. The number of ions/pulse in a 5 ns pulse is about $1.4\times10^6$, and the average current for a 1 kHz repetition rate is $1.4\times10^9$/s or about 200 pA. The merged ion beams need to be synchronized to within about 1 ns for merged ion beams with 5 ns pulses that are produced by pulsed laser desorption and synchronized in velocity within 1 m/s.

One method of measuring a fragment ion spectrum according to the present teaching includes producing ions with a first mass and a charge and also producing ions with a second mass and a charge that is opposite in polarity to the charge of the ions produced with the first mass. The ions with the first mass and charge and with the second mass and opposite charge are accelerated into a field-free reaction region so that the ions arrive at the entrance of the field-free reaction region substantially simultaneously in at least one of time and space. In some methods, ion source parameters are chosen so that ions with the first and second masses arrive at the entrance of the field-free reaction region with substantially the same velocity.

The ions can be produced using a pulsed laser desorption ion source. Time lag focusing can be used to focus the ion into the field-free reaction region where the flight time of ions is given by the following equation:

$$t=t_0+(D_e/C_1^{1/2})(m/zV)^{1/2}[1-B_1(m)^{1/2}-B_2(m)]$$

where $C_1^{1/2}=(2e/m_0)^{1/2}[2\times1.60219\times10^{-19}\ \text{coul}/1.66056\times10^{-27}\ \text{kg}]^{1/2}=1.38914\times10^4$. This value for $C_1$ gives the time in seconds for $D_e$ in meters, V in volts and mass in Da. If $D_e$ is expressed in millimeters and time in nanoseconds then $C_1=1.38914\times10^{-2}$. The coefficients $B_1$ and $B_2$ are small contributions to the time due to the initial velocity and can be accurately determined by least-squares fit to experimental spectra on known masses. The flight time is equal to the effective ion flight distance divided by the ion velocity. Measurement of flight times as functions of accelerating potential and mass can be used to independently determine the effective ion flight distance and to accurately calibrate the actual accelerating voltage relative to the nominally applied voltage. These data allow both the arrival times at the timed ion selector and the velocities for the merging beams to be accurately matched. Peak profiles of intensity as a function of flight time can also be determined using a detector.

In some methods, the ions can be refocused at a desired focal point in the field-free region so that the velocity distribution is reduced. At least some of the ions from the first and second pulsed ion source are fragmented by ion-ion collision between positive and negative ions. Coulombic attraction occurs between ions of opposite polarity, thereby increasing a probability for ion-ion collisions and subsequent fragmentation.

In some methods, the time of arrival of the first and second masses at the entrance of the field-free reaction region is less than or equal to 5 ns. In some methods, the first and second masses pass through the field-free reaction region with substantially the same velocity. In other methods, there is a relative velocity between ions with the first and the second mass that is less than or equal to about 5 m/s. In many methods, the ion source parameters and mass spectrometer geometry are chosen so that the ions with the first and second masses pass through the field-free reaction region with an overlap in time of at least 90 percent.

The fragment ions produced in the reaction region are separated according to their mass-to-charge ratio. In some methods, the fragment ions are accelerated. The polarity of the accelerated fragment ions can be the same as the polarity of ions produced with the first mass or with the second mass. The fragment ion spectrum is then detected.

The merged beam mass spectrometer of the present teaching can require calibrating. In one method of calibration, samples are loaded into both sources 104, 105 and mass spectrometer data is acquired with the source operating parameters chosen to be equal and chosen for an optimal focus at the ion detector 136. Source conditions are adjusted to focus the ion beam from the second ion source 105 at the detector 136. The first ion mirror 112 voltage is adjusted to give optimum focus for the beam from the first ion source 112. Mass spectra for a suitable standard, such as BSA digest are recorded for each and calibration parameters are determined using standard procedures for high resolution MALDI-TOF. If conditions for the first and second ion sources 104, 105 are matched, than the observed differences in flight times (relative to the local extraction pulse for each) is due to the extra time that ions produced by the first ion source spend in the first ion mirror 112. This time difference can be express by the following equation:

$$\Delta t=(D_{em}/C_1^{1/2})(\mathrm{zm/V})^{1/2}=D_{em/v(m)}$$

where $D_{em}$ is the effective length of the mirror. A least square fit to a plot of Δt vs. $(\mathrm{zm/V})^{1/2}$ allows the effective length of the mirror to be accurately determined. Any systematic variation with accelerating voltage indicates that the two sources are not accurately matched. Ions with the same velocity from the two sources can be made to arrive at the focus simultaneously by delaying the extraction pulse to the second ion source 105 by Δt relative to the extraction pulse applied to the first ion source 104. A high resolution delay generator allows the extraction pulses to be applied to the first and the second ion sources 104, 105 to be synchronized to within +/−1 ns; but the uncertainly in relative velocity will depend on the accuracy of the determination of the effective length of the mirror $D_{em}$.

In general, there is a locus of values of Δt and $v_{rel}$ that are consistent with the measured flight times, but based on calibration of other MALDI-TOF instruments this uncertainly is expected to be less than 100 ppm, corresponding to an absolute error less than 10 m/s. The basic equations for setting up a measurement with mass $m_2$ from the second ion source 105 and mass $m_1$ from the first ion source 104 are given by the following equation:

$$\Delta t=t_2(m_2)D_{em}/D_{2e} \text{ and}$$

$$V_1=V_2(z_2m_1/z_1m_2)$$

where $D_{2e}$ is the effective distance for the second ion source to the focus, and $V_1$ and $V_2$ are the respective accelerating voltages.

More accurate calibration of the relative velocity can be achieved by understanding the very strong velocity dependence of the reactions between ions of opposite charge. By varying the velocity (energy) of one of the reactants over a small range, and adjusting the time delay so that peaks from the two sources arrive simultaneously at the focus, the conditions corresponding to minimum relative velocity can be determined by simplex optimization on measuring the disappearance of a selected reactant. The minimum width of a reactant pulse in time can be determined from the width of the pulse at the detector, and the velocity distribution can be measured by focusing the ion beam at the timed ion selector 116 and measuring the beam profile at the detector.

EQUIVALENTS

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art, which may be made therein without departing from the spirit and scope of the teaching.

What is claimed is:

1. A merged beam tandem time-of-flight mass spectrometer comprising:

a) a first pulsed ion source producing a first pulsed beam of ions with ions having a first predetermined mass, first charge and first velocity;

b) a second pulsed ion source producing a second pulsed beam of ions with ions having a second predetermined mass, second charge and second velocity, wherein the second charge is opposite in polarity to the first charge and the second velocity is substantially equal to the first velocity;

c) an ion mirror that reflects the first pulsed beam of ions wherein the first and the second pulsed beams of ions are merged together in a field-free reaction region, wherein the first and second pulsed beams of ions arrive substantially simultaneously in both time and space, and with substantially the same velocity so that they react to form fragment ions;

d) a time-of-flight mass analyzer that separates the fragment ions according to their mass-to-charge ratio; and e) an ion detector positioned in the flight path after the time-of-flight mass analyzer, the ion detector detecting the separated fragment ions.

2. The merged beam tandem time-of-flight mass spectrometer of claim 1 further comprising a time delay generator programmed to produce a predetermined time delay between production of the first pulsed beam of ions and production of the second pulsed beam of ions wherein both the first and second pulsed beams of ions arrive at a predetermined point in the field-free reaction region at substantially the same time.

3. The merged beam tandem time-of-flight mass spectrometer of claim 1 wherein a relative velocity between ions produced by the first and the second pulsed ion sources is less than or equal to 5 m/s.

4. The merged beam tandem time-of-flight mass spectrometer of claim 1 wherein ions produced by the first and the second pulsed ion sources arrive at a predetermined position in the field-free reaction region with arrival times that differ by less than or equal to 5 ns.

5. The merged beam tandem time-of-flight mass spectrometer of claim 1 wherein the ions produced by the first and the second pulsed ion sources pass through the field-free reaction region with an overlap in time of at least 90 percent.

6. The merged beam tandem time-of-flight mass spectrometer of claim 1 wherein the ions produced by the first pulsed ion source are singly charged negative ions, the ions produced by the second pulsed ion source are doubly charged positive ions, and the time-of-flight mass analyzer separates positively charged fragment ions.

7. The merged beam tandem time-of-flight mass spectrometer of claim 1 wherein the ions produced by the first pulsed ion source are singly charged positive ions, the ions produced by the second pulsed ion source are doubly charged negative ions, and the time-of-flight mass analyzer separates negatively charged fragment ions.

8. The merged beam tandem time-of-flight mass spectrometer of claim 1 wherein the ions produced by the first pulsed ion source are doubly charged negative ions, the ions produced by the second pulsed ion source are singly charged positive ions, and the time-of-flight mass analyzer separates negatively charged fragment ions.

9. The merged beam tandem time-of-flight mass spectrometer of claim 1 wherein the ions produced by the first pulsed ion source are doubly charged positive ions, the ions produced by the second pulsed ion source are singly charged negative ions, and the time-of-flight mass analyzer separates positively charged fragment ions.

10. The merged beam tandem time-of-flight mass spectrometer of claim 1 wherein the ions produced by the first pulsed ion source are singly charged negative ions, the ions produced by the second pulsed ion source are singly charged positive ions, and the time-of-flight mass analyzer separates positively charged fragment ions.

11. The merged beam tandem time-of-flight mass spectrometer of claim 1 wherein the ions produced by the first pulsed ion source are singly charged positive ions, the ions produced by the second pulsed ion source are singly charged negative ions, and the time-of-flight mass analyzer separates positively charged fragment ions.

12. The merged beam tandem time-of-flight mass spectrometer of claim 1 wherein the ions produced by the first pulsed ion source are singly charged negative ions, the ions produced by the second pulsed ion source are singly charged positive ions, and the time-of-flight mass analyzer separates negatively charged fragment ion.

13. The merged beam tandem time-of-flight mass spectrometer of claim 1 wherein the ions produced by the first pulsed ion source are singly charged positive ions, the ions produced by the second pulsed ion source are singly charged negative ions, and the time-of-flight mass analyzer separates negatively charged fragment ions.

14. The merged beam tandem time-of-flight mass spectrometer of claim 1 further comprising a pulsed ion accelerator that is positioned in the flight path of the ions produced by at least one of the first and the second pulsed ion source, the pulsed ion accelerator refocusing the ions at a desired focal point while reducing a velocity distribution of the ions.

15. A method of measuring a fragment ion spectrum from a sample, the method comprising:

a) producing a first pulse of ions from the sample with ions having a first mass, first charge, and first velocity;

b) producing a second pulse of ions from the sample with ions having a second mass, second charge, and second velocity wherein the second charge is opposite in polarity to the first charge and the second velocity is substantially equal to the first velocity;

c) forming a first and second beam of ions in a field-free reaction region from the first and second pulse of ions, respectively;

d) merging the first and second beams of ions into a merged beam comprising both positive and negative ions in a field-free reaction region, wherein the first and second beams of ions arrive substantially simultaneously in both time and space, and with substantially the same velocity;

e) transferring at least one proton from a positive ion to a negative ion causing the negative ion to fragment;

f) separating fragment ions according to their mass-to-charge ratio; and g) detecting a fragment ion spectrum from the separated fragment ions.

16. The method of claim 15 further comprising refocusing the ions with at least one of the first and the second mass at a desired focal point while reducing the velocity distribution.

17. The method of claim 15 further comprising accelerating the ion fragments in the merged beam.

18. The method of claim 17 wherein the polarity of the accelerated fragment ions is the same as the polarity of ions produced with the first mass.

19. The method of claim 17 wherein the polarity of the accelerated fragment ions is the same as the polarity of ions produced with the second mass.

20. The method of claim 15 wherein ions with the first and second masses arrive at a predetermined position in the field-free reaction region with substantially the same velocity.

21. The method of claim 15 wherein ions with the first and second masses pass through the field-free reaction region with substantially the same velocity.

22. The method of claim 15 wherein a relative velocity between ions with the first and the second mass is less than or equal to 5 m/s.

23. The method of claim 15 wherein the ions with the first and second masses arrive at the entrance of the field-free reaction region with arrival times that differ by less than or equal to 5 ns.

24. The method of claim 15 wherein the ions with the first and second masses pass through the field-free reaction region with an overlap in time of at least 90 percent.

25. The method of claim 15 wherein the ions with the first and second masses pass through the field-free reaction with an overlap in space of at least 90 percent.

26. The merged beam tandem time-of-flight mass spectrometer of claim 1 wherein the first pulsed ion source comprises a MALDI source configured to produce one of singly and doubly charged positive ions from a sample of interest.

27. The merged beam tandem time-of-flight mass spectrometer of claim 1 wherein the first pulsed ion source comprises a MALDI source configured to produce one of singly and doubly charged negative ions from a sample of interest.

28. The merged beam tandem time-of-flight mass spectrometer of claim 1 wherein the second pulsed ion source comprises a MALDI source configured to produce one of singly and doubly charged ions from a sample of interest with polarity opposite to polarity of ions produced by first pulsed ion source.

29. A method of measuring a fragment ion spectrum from a sample, the method comprising:

a) producing a first pulse of ions from the sample with ions having a first mass, first charge, and first velocity;

b) producing a second pulse of ions from the sample with ions having a second mass, second charge, and second velocity wherein the second charge is opposite in polarity to the first charge and the second velocity is substantially equal to the first velocity;

c) forming a first and second beam of ions in a field-free reaction region from the first and second pulse of ions, respectively;

d) merging the first and second beams of ions into a merged beam comprising both positive and negative ions in a field-free reaction region, wherein the first and second beams of ions arrive substantially simultaneously in both time and space, and with substantially the same velocity;

e) transferring at least one electron from a negative ion to a positive ion causing the positive ion to fragment;

f) separating fragment ions according to their mass-to-charge ratio; and g) detecting a fragment ion spectrum from the separated fragment ions.

* * * * *